US007461461B2

(12) United States Patent
Howell

(10) Patent No.: US 7,461,461 B2
(45) Date of Patent: Dec. 9, 2008

(54) KWIK LEADS

(76) Inventor: Stephen E. Howell, 1919 Ashemere Dr., Iron Station, NC (US) 28080

( * ) Notice: Subject to any disclaimer, the term of this patent is extended or adjusted under 35 U.S.C. 154(b) by 4 days.

(21) Appl. No.: 11/526,333

(22) Filed: Sep. 25, 2006

(65) Prior Publication Data

US 2007/0017107 A1 Jan. 25, 2007

Related U.S. Application Data

(63) Continuation-in-part of application No. 11/088,624, filed on Mar. 24, 2005, now abandoned.

(60) Provisional application No. 60/556,791, filed on Mar. 29, 2004.

(51) Int. Cl.
*G01C 15/10* (2006.01)

(52) U.S. Cl. ..... 33/404; 33/407

(58) Field of Classification Search ..... 33/365, 33/391, 404–410, 427, 464
See application file for complete search history.

(56) References Cited

U.S. PATENT DOCUMENTS

| | | | | |
|---|---|---|---|---|
| 2,286,669 | A * | 6/1942 | Carr | 33/408 |
| 2,686,974 | A * | 8/1954 | Lanner | 33/404 |
| 3,102,339 | A * | 9/1963 | Pagona | 33/410 |
| 4,574,492 | A * | 3/1986 | Miller | 33/427 |
| 4,932,135 | A * | 6/1990 | Wobser, II | 33/408 |
| 5,456,015 | A * | 10/1995 | Butcher et al. | 33/474 |
| 6,513,286 | B2 * | 2/2003 | Vierra | 33/406 |
| 6,857,234 | B2 * | 2/2005 | Goudreau et al. | 33/408 |
| 2001/0039741 | A1 | 11/2001 | Kirk | |
| 2003/0079437 | A1 * | 5/2003 | Near | 33/408 |

* cited by examiner

*Primary Examiner*—G. Bradley Bennett
(74) *Attorney, Agent, or Firm*—Clements Bernard Miller; Gregory N. Clements

(57) ABSTRACT

An improved a tool for aiding in laying a brick wall a set distance from the base wall of a structure, and to confirm the verticality of the brick wall. The tool has an elongated member having a smooth face for contacting a wall of bricks, an end member is attached to the end of the elongated member at a right angle thereto, the end member being attached in an adjustable manner. The method of using the tool is also disclosed.

4 Claims, 3 Drawing Sheets

KWIK LEADS

CROSS REFERENCE TO RELATED APPLICATIONS

This application is a continuation-in-part of U.S. patent application Ser. No. 11/088,624, filed on Mar. 24, 2005, now abandoned. This application also claims the benefit of U.S. Provisional Patent Application No. 60/556,791, filed Mar. 29, 2004.

FIELD OF THE INVENTION

The present invention relates to brick laying, and more particularly to a method and apparatus for properly aligning bricks by a brick mason.

BACKGROUND OF THE INVENTION

The art of brick laying is hundreds of years old. Typically, brick layers rely on line of sight for establishing the verticality of walls. Consequently, bricklaying is expensive. Aspects of bricklaying which require particular skill and time include laying level courses of brick during formation of a wall, and maintaining a true vertical wall face. These constructions are performed by hand, laborious, and particular attention is required to make the wall as close as possible to a true vertical.

An important problem confronted in conventional brick laying is that there are no adequate tools for accurately placing bricks to establish a perfectly plumb wall in restricted spaces, such as under eaves.

Accordingly, what is needed is a device to aid the bricklayer in establishing a plumb wall a specific distance from the wall for which the brick wall will become the outer face.

The work performed without this tool takes approximately two to three times longer with inferior quality results. Another problem with conventional brick laying is the additional manpower required. Also, using the line of sight method with conventional brick laying can produce results of unacceptable quality.

In this respect, the Kwik Leads tool according to the present invention substantially departs from the conventional concepts and designs of the prior art, and in so doing provides an apparatus primarily developed for the purpose of ease of brick laying and improved quality in the manufacture of homes and commercial buildings.

Although the invention is described with relation to the laying of bricks, the term "bricks" as used throughout this application is to be understood to be any type of masonry, including, without limitation, brick, cement block, stone, and tile.

SUMMARY OF THE INVENTION

The invention is a generally T-shaped tool, the top member of which is adjustable with relation to the base member, and which can be fixed into a desired orientation with relation to the base member. In operation, the distance from the wall of the structure to the desired location of the brick face is determined, and that distance is set on the tool by affixing the shorter cross member to the base or elongated member by set screws or bolts. The tool is then utilized to confirm the distance from the base wall to the brick face frequently during the laying of the bricks.

A structure is built with a wall having an outer skin thereon, frequently insulation, after which a brick wall is laid on the face of the outer skin, or frequently spaced from the outer skin of the wall. During normal operation, the brick mason lays a course of brick in the normal manner, and continues in the same manner utilizing a level in the vertical position for several courses, until the height of the brick wall exceeds the length of the invented Kwik Leads tool or guide. The tool is set prior to commencing the facing of the wall with brick. The desired distance from the outer skin and the face of the brick is determined, and the top member is fixed so that it extends beyond the face of the elongated base member the desired distance which is equal to that from the face of the brick wall to the outer skin of the structure. The bricklayer then places the bottom of the top member of the tool on the top course of brick with the end of the top member of the tool against the outer skin and the inner face of the elongated base member against the face of the brick to determine the verticality of the wall, and to provide an exact location for the face of the brick.

The present invention is particularly useful for laying a vertical wall, especially in the region where there is an overhang, such as under eaves.

The invented apparatus has an elongated member having a smooth face for contacting a wall of bricks. An end member is attached to the end of the elongated member at a right angle thereto. The end member is advantageously attached in an adjustable manner. The elongated member may be provided with a handle for ease of manipulation.

OBJECTS OF THE INVENTION

The principal object of the invention is to provide apparatus for laying a brick wall.

Another object is to provide a tool that simplifies masonry work, and improves the quality of the masonry work.

Another object of the invention is to provide a masonry tool that is simple and easy to maintain and operate.

Another object is to provide a masonry tool that is light weight and durable.

Another object is to provide an improved method of laying a brick wall.

A further object of this invention is to provide a method of laying brick in heretofore difficult-to-lay regions of a structure.

Another object of the invention is to provide a tool for aiding in laying a brick wall a set distance from the base wall of a structure, and to confirm the verticality of the brick wall face.

BRIEF DESCRIPTION OF THE DRAWINGS

The foregoing and other objects will become more readily apparent by referring to the following detailed description and the appended drawings in which.

DETAILED DESCRIPTION

Figure 1:
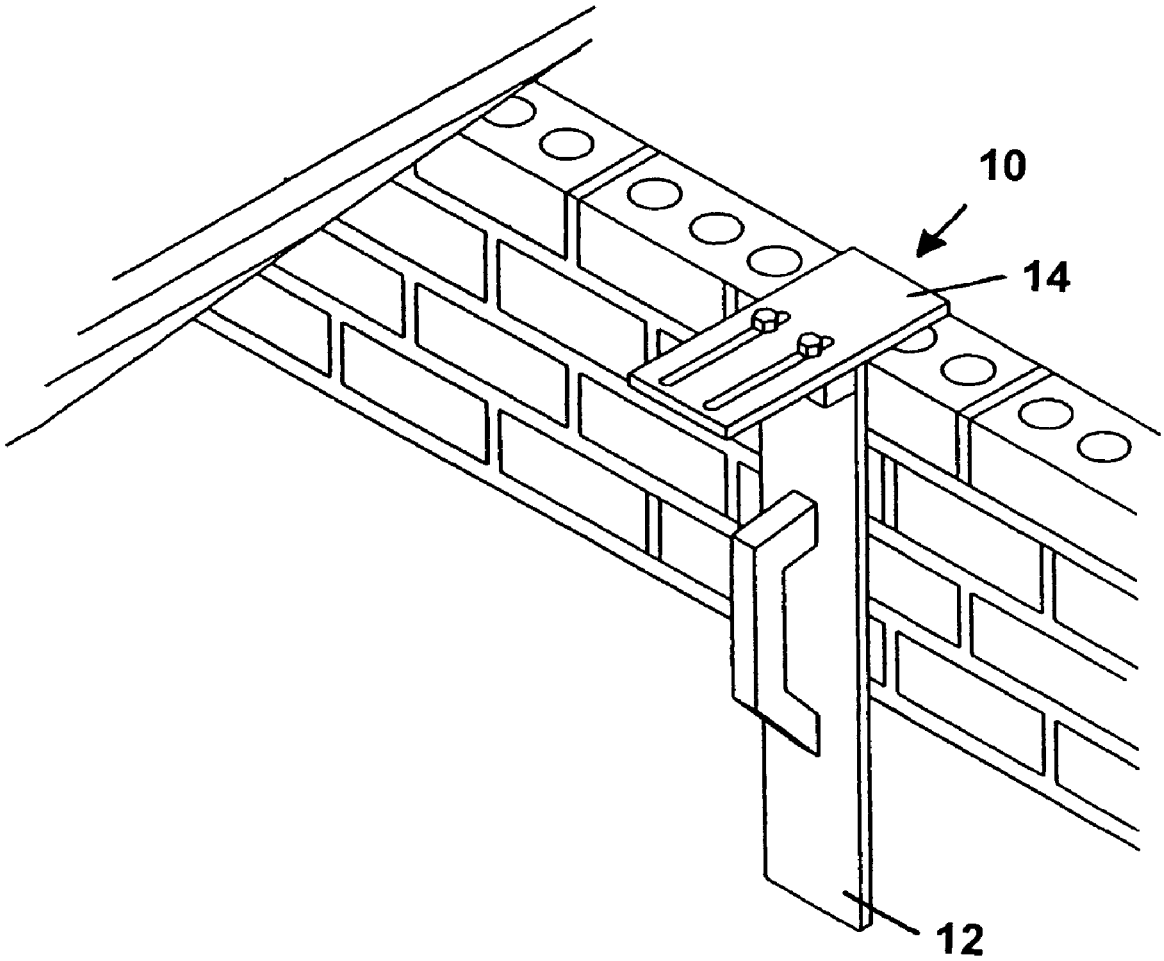
FIG. 1 is an isometric view of the invented tool in use on a brick wall.
Figure 4:
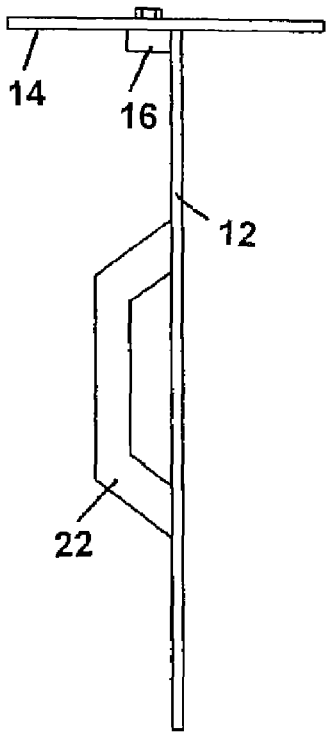
FIG. 4 is a right side view of the invented tool, the left side view being a mirror image thereof.
Figure 5:
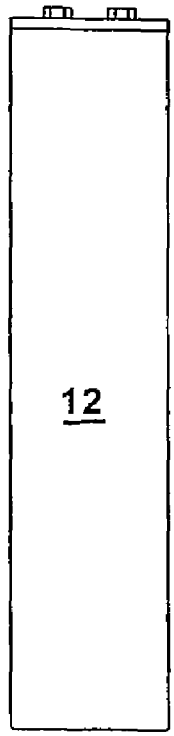
FIG. 5 is a rear view of the invented tool.

Referring now to the drawings, and particularly to FIG. 1, the invented Kwik Leads device 10 includes an elongated base member 12, an end member 14 which forms a "T" with the base member 12, and adjustable connecting means between the members 12 and 14. Between the base member 12 and the end member is a connector flange 16 which can be integral with the base member as shown by reference numeral 36 in FIG. 7, welded or otherwise fixed to the base member, or it can be an intermediate block, as shown in FIG. 4, which is fixed to the base member with screws, not shown, and thus becomes part of the base member. The adjustable connection can include two parallel slots 18 at right angles to the base member, with bolts 20 which connect to the connector flange or block. The bolt receiving hole or holes in the connector flange or block are preferably drilled and tapped. Alternatively, regular bolts with nuts can be employed.

A handle 22 may be provided for ease in holding and manipulating the tool in different directions, and in placing and removing the Kwik Leads tool in the brick laying process. The handle 22 may be generally "U" shaped, as shown, or may have any other desired shape.

Figure 3:
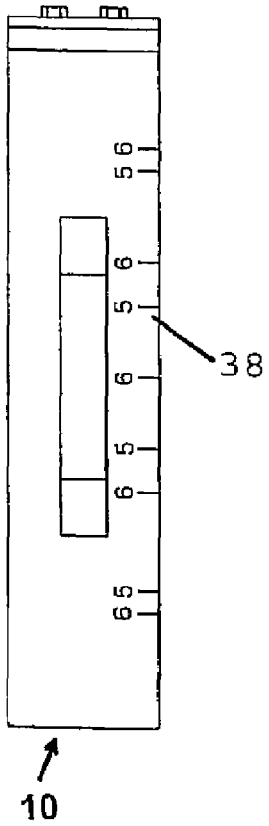
FIG. 3 is a front view of the invented tool.

The base member is advantageously provided with a scale 38 with measurements stamped or etched thereon at various desired locations, as shown in FIG. 3, and used as the brick mason's course guide.

In the process of brick laying, all bricks must be put into place to form a described architecture. The bricks must be straight and uniform. Conventional methods of brick laying allows a certain amount of deviation, which can result in a wall structure being several inches out of plumb, which would cause it to be rejected by the contractor. The invented tool is used to ensure that each row of brick is exactly the same distance from the face of the brick to the face of the wall. The mason lays two or three bricks then uses the Kwik Leads tool to ensure plumb. By holding the end of the adjustable end member against the existing wall, the bricks are checked for plumb or verticality, and are also checked for uniformity against the scale on the elongated member.

The invented tool is preferably made from aluminum, can be made from any suitable materials, including aluminum, steel, wood, and plastics, or a combination thereof.

Advantageously, the base member and end members are made of ¼ inch aluminum plate, and the connector block is also aluminum, which may be drilled and tapped to receive the required connecting screws and adjusting bolts. A conveniently sized tool has a 3½"×7¼" end member and a 3½"×16" base member.

Figure 2:
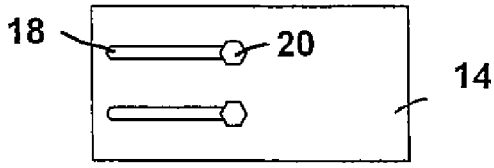
FIG. 2 is a top view of the invented tool.
Figure 6:
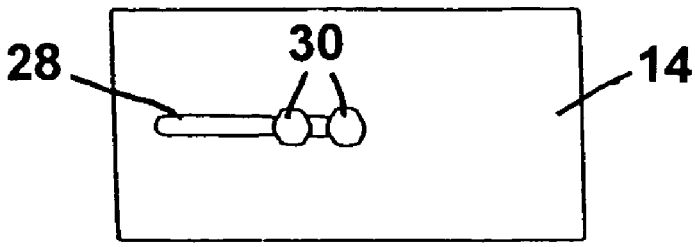
FIG. 6 is a top view of an alternative embodiment of the invented tool.
Figure 7:
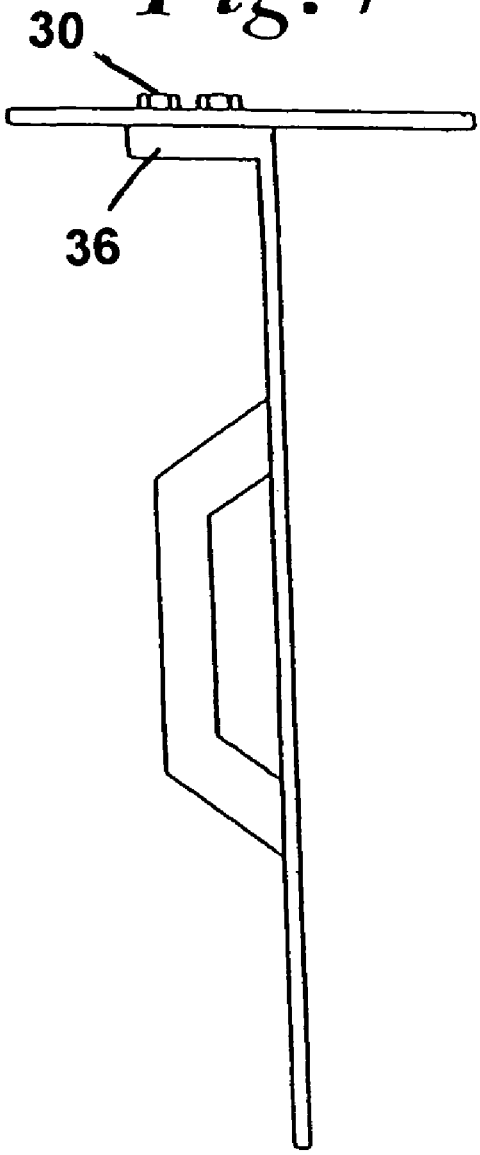
FIG. 7 is a right side view of the alternative embodiment of FIG. 6, the left side view being a mirror image thereof.

The adjusting mechanism can be a pair of parallel slots 18 in the cross member with an adjusting screw or bolt 20 in each as shown in FIGS. 2 and 4, or it can be a single slot 28 in the cross member with a pair of adjusting bolts 30 in the slot 28 as shown in FIGS. 6 and 7 to hold the cross member in proper orientation, which is normal (at a right angle) to the elongated member.

SUMMARY OF THE ACHIEVEMENT OF THE OBJECTS OF THE INVENTION

From the foregoing, it is readily apparent that I have invented an improved method and apparatus for laying a brick wall, particularly in heretofore difficult to lay regions of a structure, and a tool for aiding in laying a brick wall a set distance from the base wall of a structure, and to confirm the verticality of the brick wall face faster and more economically than heretofore has been possible.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A guide tool for the laying of brick during formation of a vertical wall upon a structure, comprising:

an elongated first member for placing against the face of bricks in a wall wherein said member is substantially rectangular and has substantially planar inner and outer surfaces, wherein said first member is provided with a scale with measurements stamped or etched thereon at various desired locations, a second member for contacting bricks attached to said first member at a right angle thereto, wherein said second member is substantially rectangular and has substantially planar inner and outer surfaces, wherein said second member is provided with an elongated slot in its longitudinal direction, means for adjusting the distance the second member extends beyond said first member, wherein said adjusting means comprises an adjusting screw extending through said slot in said second member into said first member, means for fixing the relationship of said second member to said first member; and a handle attached to said first member.

2. A guide according to claim 1 wherein said second member is provided with a pair of parallel elongated slots in its longitudinal direction, and said adjusting means comprises an adjusting screw extending through each of said slots in said second member into said first member.

3. A guide according to claim 1 wherein said guide is made from the group of materials comprising aluminum, steel, wood, and plastics, or a combination thereof.

4. A method for confirming the verticality of a brick wall face during its construction, comprising the steps of:

a) providing a tool for properly aligning bricks vertically, comprising:

an elongated member for placing against the face of bricks in a wall wherein said member is substantially rectangular and has substantially planar inner and outer surfaces, wherein said elongated member is provided with a scale with measurements stamped or etched thereon at various desired locations;

a cross member attached to the end of said elongated member at a right angle thereto wherein said cross member is substantially rectangular and has substantially planar inner and outer surfaces;

means for adjusting the relationship of said cross member to said elongated member wherein said adjusting means comprises an adjusting screw extending through said slot in said second member into said first member; and a handle attached to said elongated member;

b) determining the desired distance from the outer skin of a base wall and the face of a brick wall to be laid;

c) fixing the top member to the end of the elongated base member so that it extends beyond the face of the elongated base member the desired distance;

d) commencing to lay brick;

e) placing the bottom of the top member of the tool on the top course of brick with the end of the top member of the tool against the outer skin and the inner face of the elongated base member against the face of the brick to determine the verticality of the wall; and f) adjusting the bricks as necessary for plumb and distance from the outer skin of the base wall.

* * * * *